United States Patent [19]

McMillin

[11] Patent Number: 4,940,165

[45] Date of Patent: Jul. 10, 1990

[54] METHOD OF AND DISPENSING HEAD FOR INCREASED CARBONATION

[75] Inventor: John R. McMillin, San Clemente, Calif.

[73] Assignee: The Cornelius Company, Anoka, Minn.

[21] Appl. No.: 179,331

[22] Filed: Apr. 8, 1988

[51] Int. Cl.[5] ..... B67D 5/56; F16K 19/00

[52] U.S. Cl. ..... 222/129.1; 222/145; 222/564; 239/416.5; 137/170.3

[58] Field of Search ..... 222/129.1, 129.2, 129.3, 222/564, 145; 251/118; 138/42, 44; 137/170.3, 170.4, 170.5; 239/590.5, 533.1, 416.5

[56] References Cited

U.S. PATENT DOCUMENTS

| | | | |
|---|---|---|---|
| 2,726,841 | 12/1955 | Crist | 138/42 |
| 3,966,091 | 6/1976 | Bencic | 222/129.1 |
| 4,509,690 | 4/1985 | Austin et al. | 222/129.1 |
| 4,549,675 | 10/1985 | Austin | 222/129.1 |
| 4,667,700 | 5/1987 | Buzzi | 239/533.1 |
| 4,760,940 | 8/1988 | Wallace et al. | 222/129.1 |

FOREIGN PATENT DOCUMENTS

| | | | |
|---|---|---|---|
| 743485 | 12/1969 | Belgium | 222/564 |

*Primary Examiner*—Andres Kashnikow
*Assistant Examiner*—Christopher G. Trainor
*Attorney, Agent, or Firm*—Henry C. Kovar

[57] ABSTRACT

A beverage dispensing head and a method of dispensing that provides increased carbonation in a dispensed fountain beverage. The dispensing head has a discrete carbonated water decompression chamber in-between an upstream volumetric flow control body and a downstream normally closed valve. The method includes the steps of propelling carbonated water through a flow control body and then decompressing the carbonated water before it reaches the normally closed valve.

18 Claims, 1 Drawing Sheet

METHOD OF AND DISPENSING HEAD FOR INCREASED CARBONATION

BACKGROUND OF THE INVENTION

1. Field of the Invention

This invention pertains to a dispensing head and a method of dispensing for providing increased carbonation in a dispensed fountain soft drink.

2. The Prior Art

F. L. AUSTIN U.S. Pat. No. 4,549,675 has a post-mix carbonated beverage dispensing head with discrete pathways for water and syrup which both lead to a mixing nozzle. This particular dispensing head is available with two types of volumetric flow rate control for the water. The first type is a fixed elastomeric washer and the second type is a movable piston in a sleeve with an adjustable biasing spring.

The highest level of carbonation that has been obtainable from this dispensing head has been 3.6 volumes of carbon dioxide. More carbonation is wanted and needed, particularly with the most popular cola beverages.

OBJECTS OF THE INVENTION

It is an object of the present invention to provide an improved apparatus for and method of increasing the carbonation of a fountain dispensed beverage.

It is an object of the present invention to provide in a carbonated water dispensing head having discrete passageways and normally closed valves, the improvement for increasing carbonation of a toroidal carbonated water decompression chamber upstream of the normally closed valve.

It is an object of the present invention to provide a carbonated beverage dispensing system having a dispensing head with syrup and carbonated water passageways with inlets and normally closed valves, a volumetric flow rate control for the water, and a carbonated water decompression chamber in-between the inlet and the water valve.

It is an object of the present invention to provide a method of increasing carbonation in a dispensed beverage by firstly controlling the volumetric flow rate of carbonated water, then decompressing the carbonated water, and then feeding the decompressed water through a normally closed valve and a nozzle with a receptacle.

SUMMARY OF THE INVENTION

In a carbonated water dispensing head having a carbonated water inlet port, flow control housing, flow control piston, water feed port from the housing to a normally closed valve, and an outlet from the valve to a nozzle, the improvement of a toroidal carbonated water decompression chamber between the flow control piston and the normally closed valve.

A carbonated beverage dispensing system has a dispensing head with syrup and carbonated water inlets, a syrup passageway leading to a nozzle, a carbonated water passageway leading to the nozzle, a normally closed valve in each passageway, a volumetric flow rate control in the water passageway, and a carbonated water decompression chamber downstream of the flow control and upstream of the water valve.

A method of increasing the carbonation of fountain dispensed carbonated water having the steps of providing carbonated water at a propellant pressure volumetrically controlling the rate of water flow, decompressing the carbonated water after controlling the rate of flow, and then feeding the decompressed carbonated water to and through a normally closed valve and to a nozzle and into a receptacle.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

DESCRIPTION OF THE PREFERRED EMBODIMENT

Figure 1:
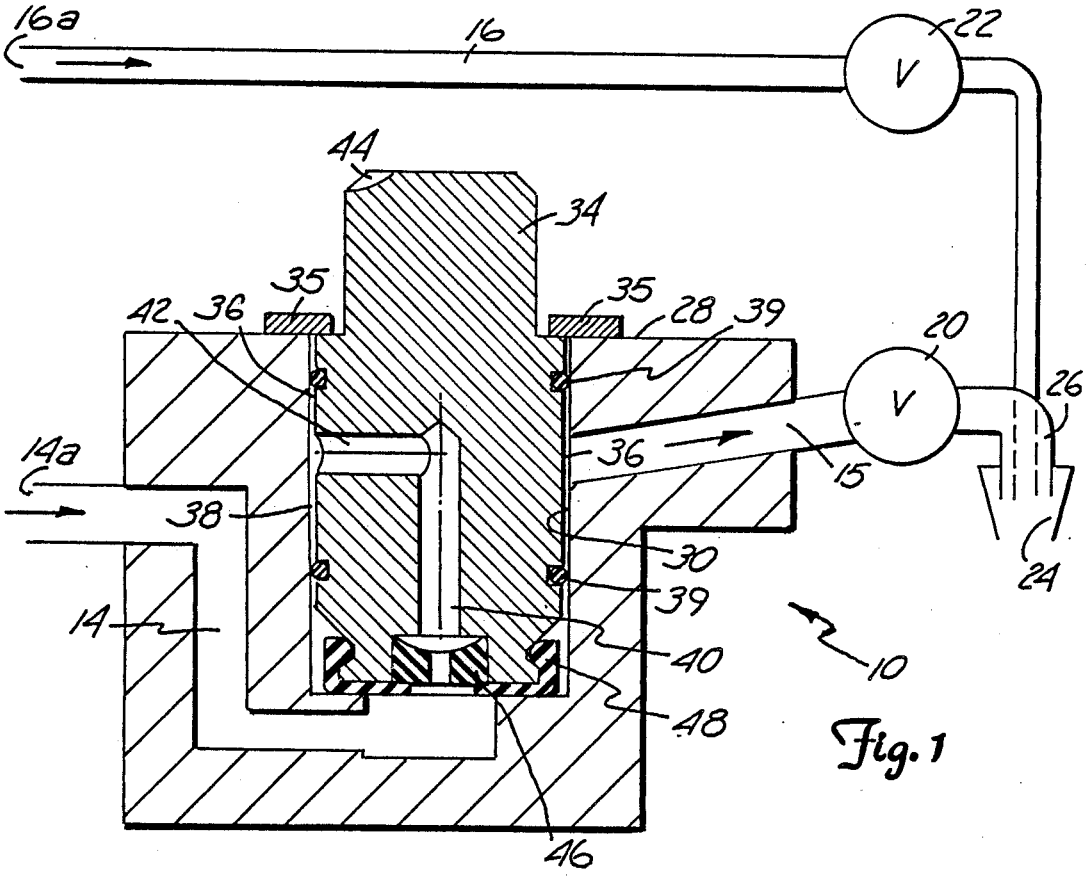
FIG. 1 is an elevational view in section of the preferred embodiment of the structure of the present invention.
Figure 2:
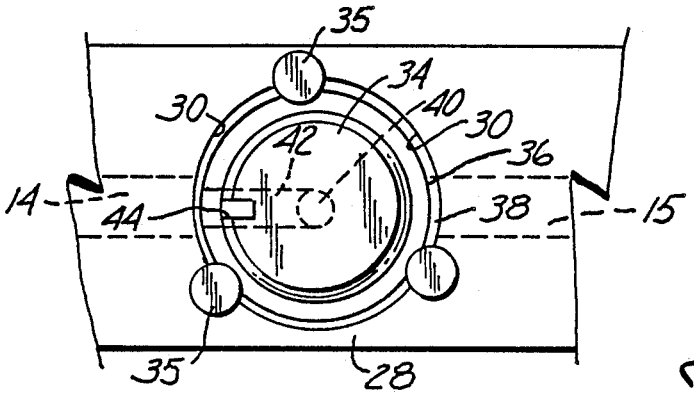
FIG. 2 is a top plan view of the structure of FIG. 1.

According to the principles of the present invention a carbonated beverage dispensing head is provided as shown in FIG. 1 and which is generally indicated by the numeral 10. A preferred specific example of a complete dispensing head is the subject of F. L. AUSTIN U.S. Pat. No. 4,549,675 of Oct. 29, 1985, which is incorporated into this application by reference thereto. The basic structural components of the dispensing head 10 include a carbonated water passageway extending through head 10 which passageway includes an inlet port 14 having an inlet connecting end **14*a* connectible to a source of pressurized carbonated water (not shown), and an outlet water feed port 15. There is also provided a discrete syrup passageway 16 having an inlet connecting end 16*a* which is connectible to a discrete source of beverage syrup (not shown). Passageway 16 and outlet port 15 each have a discrete normally closed valve 20, 22 respectively, that is openable for dispensing of beverage. The water valve 20 is usually also operable by itself, for dispensing pure carbonated water without syrup. The syrup passageway 16 ultimately leads to a dispensing nozzle 24 as does a water outlet port 26 extending from the water valve 20 to the nozzle 24. A specific dispensing nozzle 24 may be the one shown in U.S. Pat. No. 4,549,675, may be the one shown in U.S. Pat. No. 4,509,690, or may be of other common or yet to be developed types. The nozzle 24 usually initially mixes the carbonated water and syrup together prior to the beverage falling into any appropriate receptacle, such as a cup or pitcher (not shown). In-between the water inlet port 14 and the water valve 20 is a cylindrical water flow control housing 28 having an elongate cylindrical inner surface 30 defining an inner pocket of the housing 28. The water inlet portion 14 extends into the bottom of the housing 28 and into fluid communication with the inner surface 30. Outlet feed port 15 intersects through the cylindrical inner surface 30 and into the housing 28. The feed port 15 extends directly from the housing 28 to the normally closed water valve 20**.

A fixed water flow control shaped like a piston plug 34 is inserted, fixed, retained, in and sealed to the housing 28. Piston 34 is retained in housing 28 by retaining means 35. The combined structure of the piston 34 and cylindrical inner surface 30 is the important structural feature of this invention and is important structure in the practice of the method of the present invention.

The piston 34 has precisely sized outer diametric surface 36 loosely slip-fitted within the cylindrical inner surface 30. A preferred specific diameter of the diametric piston surface 36 is 0.823±0.001 inches (20.9±0.025 mm) and a preferred specific diameter of the cylindrical inner surface 30 is 0.842±0.002 inches 21.4±0.05 mm). The annular clearance between the surfaces 30, 36 is in the range of 0.005–0.015 inches (0.125–0.375 mm) and a specific preferred clearance is 0.010±0.002 inches (0.25±0.05 mm). A toroidal carbonated water decompression chamber 38 is formed between the surfaces 30, 36 and O-rings 39, and is the annular clearance just specifically identified. A carbonated water flow port 40 extends upward from the bottom of the piston 34 and fluidly branches off into a single outlet 42 which interacts with and through the piston diametric surface 36 into the chamber 38.

A preferred diameter of the flow port 40 and its outlet 42 is 0.125 inch (3.18 mm) diameter. A radial index indicator 44 is provided on the outer end of the piston 36. The indicator 44 has a fixed radial location with respect to the flow port outlet 42 for selective and predetermined radial orientation of the single outlet 42 within the housing 28. The preferred orientation of the outlet 42 is directly opposite to the feed port 15.

Opposite orientation provides a parallel flow path in the decompression chamber 38. The flow path extends from the outlet 42 around both sides of the piston 34 to the feed port 15. In the bottom of the piston 34 and at the inlet of the flow port 40 is a fixed rate elastomeric volumetric flow control washer 46. The washer 46 is held captive in the piston 34 by a snap fit retainer cap 48. The flow washer 46 is preferably non-adjustable and is always upstream of the decompression chamber 38. The decompression chamber 38 is of a precise predetermined size and is not adjustable.

The cross sectional areas of the various section of the water passageway is quite critical. The water inlet port 14 has a relatively quite large cross sectional area. The water 15, and water valve 20 and water outlet port 26 have a minimum diameter of 0.160 inches (4.06 mm) and therefore a minimum cross sectional area of 0.020 square inches. The inlet port 14 is preferably larger than the feed port 15. The flow port 40 has a cross sectional area of 0.012 square inches and is smaller in cross section through the feed port 15. The decompression chamber 38 has a preferred height of 0.265 inches (6.7 mm) and has a singular cross sectional flow pathway area of 0.0065 square inches and a parallel double flow pathway area of 0.013 square inches. The cross sectional area of the decompression chamber is always smaller than the smallest cross sectional area in the feed port 15, open water valve 20, outlet port 26 or nozzle 24. The flow port 40 has a larger cross-sectional area than the decompression chamber 38 but smaller than any cross sectional area downstream of the decompression chamber 38.

In the use of the dispensing head 10 and the beverage dispensing system as described, and in the practice of the method of the present invention, carbonated water under a predetermined propellant pressure is provided at the inlet connecting end 14*a*. When the water valve 20 is normally closed, full propellant pressure is hydrostatically applied all the way through the water passageway ports 14 and 15 to the water valve 20. During dispensing the water valve 20 is solely opened to dispense only carbonated water, and both valves 20, 22 are opened to dispense a complete soft drink. Syrup flows through the syrup passageway 16 and into and out of the nozzle 24 in conventional fashion.

The carbonated water however, flows firstly through the flow washer 46 wherein the volumetric flow rate is controlled. Specific preferred predetermined carbonated water flow rates are 1.25 oz./sec. regular flow and 2.50 oz./sec. high flow. The carbonated water leaves the flow washer 46 and enters and goes through the reduced cross section flow port 40 and through the piston 34. An initial partial pressure reduction is made in the flow port 40. The carbonated water then exits out of the flow port 40 and into the highly restrictive decompression chamber 38. The flow of carbonated water through the chamber 38 is laminar & non-turbulent, and provides the greatest pressure drop experienced by the carbonated water, specifically the carbonated water is depressurized down to just above atmospheric. The carbonated water then is fed out the feed port 15, and through the valve 20 and the outlet feed port 15, and through the valve 20 and the outlet port 26 to the nozzle 24 and then into the receptacle. The pressure drop downstream of the decompression chamber 38 is negligible.

It has been found, in actual testing, that whereas the original dispensing valve us U.S. Pat. No. 4,549,675 with the high efficiency nozzle of U.S. Pat. No. 4,509,690, would put a beverage into a cup with 3.6 volumes of carbonation. The improved dispenser head 10 and the method herein described provide a dispensed fountain beverage into a cup which consistently measures to have 4.2 volumes of carbonation with less foaming of the beverage during dispensing. The dispensed carbonated water per se without syrup likewise has a higher carbonation in the cup.

Although other advantages may be found and realized and various modifications may be suggested by those versed in the art, it should be understood that I wish to embody within the scope of the patent warranted hereon, all such embodiments as reasonable and properly come within the scope of my contribution to the art.

I claim as my invention:

1. In a carbonated water dispensing head having a carbonated water inlet port leading to a flow control housing having a cylindrical inner surface, a carbonated water flow control body fixed in and sealed to said housing, a self compensating water flow rate control device in said body, a water feed port from the cylindrical inner surface to a normally closed water valve, and an outlet port from the water valve to a dispensing nozzle;

the improvement for providing increased carbonation in dispensed carbonated water, comprising a flow control body outer diametric surface (fitted) positionally fixed within and sealed to the housing cylindrical inner surface, a carbonated water flow port through the inside of said flow control body and said flow rate control device and into fluid communication with said inner surface, said housing cylindrical inner surface and said outer flow control body diametric surface jointly defining in a toroidal space between them a carbonated water decompression chamber downstream of said flow rate control device, said decompression chamber being fluidly between the inlet port and the feed port and downstream of the flow control body, said decompression chamber having a carbonated water passageway area which is less than the area of the feed port.

2. The improvement of claim 1, in which said flow port projects through the flow control body outer diametric surface.

3. The improvement of claim 2, in which said flow port has a single carbonated water outlet transversely through through the flow control body outer diametric surface, said single outlet being on an opposite side of the housing from said feed port.

4. The improvement of claim 3, including a parallel decompression flow path from the single outlet and around both sides of the flow control body outer diametric surface to the feed port.

5. The improvement of claim 3, including a radial index indicator on an outer face of said flow control body, said index indicator being in a predetermined radial position with respect to said single flow port outlet.

6. The improvement of claim 1, in which the decompression chamber has an annular width in the range of 0.005 to 0.015 inch (0.13 to 0.40 mm).

7. The improvement of claim 6, in which the decompression chamber has an annular width of 0.010±0.002 inch (0.25±0.05 mm).

8. The improvement of claim 1, in which said decompression chamber has a smaller area than any portion of the downstream carbonated water passageway.

9. The improvement of claim 1, in which said flow port has a larger cross sectional area than the decompression chamber, but a smaller cross sectional area than any portion of the water port downstream of the decompression chamber.

10. A carbonated beverage dispensing system comprising a dispensing head having a syrup inlet connectible to a source of syrup and a carbonated water inlet connectible to a source of pressurized carbonated water;

a syrup passageway extending through the syrup inlet to a dispensing nozzle on the head;

a carbonated water passageway extending through the water inlet to said nozzle;

a normally closed valve in each passageway;

a volumetric flow rate control device in the carbonated water passageway, said control device having a self-compensating flow rate controlling orifice; and a carbonated water decompression chamber spaced downstream of said flow rate control orifice and upstream of the water valve, said chamber having a fixed size smaller cross-sectional area than any part of the water passageway either upstream of downstream of said chamber.

11. The dispensing system of claim 10 in which the water passageway includes a flow port between the flow control device and the decompression chamber, said flow port having a cross-sectional area smaller than that portion of the passageway downstream of the decompression chamber.

12. The dispensing system of claim 10, in which said decompression chamber is of nonmovably positionally fixed as is of fixed size and is nonadjustable.

13. The dispensing system of claim 10, in which said flow control body is retrofitted in a previously existing housing, thereby improving a previously existing beverage system.

14. The dispensing system of claim 13 wherein said control device is a nonadjustable flow control washer in and retained to said flow control body as a unit which is installable in said head.

15. In a carbonated water dispensing head having a carbonated water inlet port leading to a flow control housing having a cylindrical inner surface, a carbonated water flow control body in said housing, a water feed port from the cylindrical inner surface to a normally closed water valve, and an outlet port from the water valve to a dispensing nozzle;

the improvement for providing increased carbonation in dispensed carbonated water, comprising a flow control body outer diametric surface fitted within the housing cylindrical inner surface, a carbonated water flow port through the inside of said flow control body and into fluid communication with said inner surface, said housing cylindrical inner surface and said flow control body outer diametric surface jointly defining in a toroidal space between them a carbonated water decompression chamber, said decompression chamber being fluidly between the inlet port and the feed port and downstream of the water flow port and having a carbonated water passageway area which is less than the area of the feed port, and said flow control body including an elastomeric water volumetric flow rate washer located therein and spaced upstream of said decompression chamber.

16. The improvement of claim 15, in which said flow washer is held captive in said flow control body by a retainer cap.

17. The improvement of claim 15, in which said flow washer is held captive to said control body by a retainer secured to said control body.

18. An improved carbonated beverage dispensing system comprising a dispensing head having a syrup inlet connectible to a source of syrup and a carbonated water inlet connectible to a source of pressurized carbonated water;

a syrup passageway extending through the syrup inlet to a dispensing nozzle on the head;

a carbonated water passageway extending through the water inlet to said nozzle;

a normally closed valve in each passageway;

a volumetric flow rate control device in the carbonated water passageway, said control device having a flow controlling orifice;

a carbonated water decompression chamber spaced downstream of said flow control device orifice and upstream of the water valve, said chamber having a smaller cross-sectional area than any part of the water passageway either upstream or downstream of said chamber, said decompression chamber being a toroidal chamber between a flow control body and a flow control housing, said water passageway extending through said body and said housing, and in which said control device is a nonadjustable flow control washer in and retained to said flow control body as a unit which is installable in said head.

* * * * *